US008488995B2

(12) United States Patent
Takeda

(10) Patent No.: US 8,488,995 B2
(45) Date of Patent: Jul. 16, 2013

(54) IMAGE FORMING APPARATUS

(75) Inventor: Atsushi Takeda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 322 days.

(21) Appl. No.: 12/842,833

(22) Filed: Jul. 23, 2010

(65) Prior Publication Data

US 2011/0020035 A1 Jan. 27, 2011

(30) Foreign Application Priority Data

Jul. 27, 2009 (JP) ..... 2009-174520

(51) Int. Cl.
*G03G 15/00* (2006.01)

(52) U.S. Cl.
USPC ..... 399/159; 399/1; 399/4; 399/252

(58) Field of Classification Search
USPC ..... 399/1, 4, 159, 252
See application file for complete search history.

(56) References Cited

U.S. PATENT DOCUMENTS

| | | | | |
|---|---|---|---|---|
| 5,561,021 | A | 10/1996 | Yamazaki et al. | |
| 7,194,226 | B2 | 3/2007 | Adachi et al. | |
| 2002/0037464 | A1* | 3/2002 | Kawada et al. | 430/66 |
| 2003/0215731 | A1* | 11/2003 | Saiki et al. | 399/284 |
| 2008/0240785 | A1* | 10/2008 | Ito et al. | 399/218 |
| 2009/0202263 | A1* | 8/2009 | Yoshida et al. | 399/49 |

FOREIGN PATENT DOCUMENTS

| | | |
|---|---|---|
| JP | 06-250413 | 9/1994 |
| JP | 07-230177 | 8/1995 |
| JP | 09-274364 | 10/1997 |
| JP | 11-184216 | 7/1999 |
| JP | 2001-13788 | 1/2001 |

* cited by examiner

*Primary Examiner* — Ryan Walsh
(74) *Attorney, Agent, or Firm* — Canon USA Inc IP Division

(57) ABSTRACT

A cleaner-less image forming apparatus includes an LED which is arranged with a closest distance of 10 to 5000 μm to a photosensitive member and exposes the photosensitive member. In the image forming apparatus, an absolute value of an average charge of a developer is between 50 μC/g and 90 μC/g, and a contact angle of the photosensitive member with respect to pure water is not less than 90° and not more than 150°.

4 Claims, 14 Drawing Sheets

IMAGE FORMING APPARATUS

BACKGROUND OF THE INVENTION

1. Field of the Invention

The present invention relates to an electrophotographic image forming apparatus.

2. Description of the Related Art

In recent years, from a viewpoint of compactness, low in cost, and concern for the environment, a demand for an image forming apparatus which consumes less energy and produces less waste toner has increased. Compared with a conventional laser optical system, a light-emitting diode (LED) exposure system has a short optical path and contributes to a miniaturization of a main body of the system. Further, it does not need a polygon motor, so that energy consumption can be reduced. At present, however, LEDs need to be located close to an object to be exposed on account of light quantity. Therefore, a close proximity exposure system is adopted. In an ordinary electrophotographic operation, a surface of a photosensitive member is electrostatically charged and exposed to form a latent image, and after the latent image on the photosensitive member is visualized as a developed image by development processing, the developed image is transferred to paper in transfer processing. A residual transfer toner on the photosensitive member is removed by a cleaning (CLN) mechanism, and the procedure is repeated from the charging processing. In this case, the residual transfer toner becomes waste toner.

On the other hand, a so-called CLN-less system has been discussed which recovers the residual transfer toner without using the CLN mechanism while forming a developed image in the development processing. The CLN-less system is an energy-saving technology, which can realize waste toner less image formation and reduce drive power consumption because this system does not use the CLN mechanism which has been a main cause of a drive torque of the photosensitive member.

However, for example, Japanese Patent Application Laid-Open No. 11-184216 discusses that in a case where a proximity exposure system is combined with a CLN-less system, since toner exists and passes through the photosensitive member in an exposure unit, the toner adheres to the exposure unit, resulting in defective images. If an electric charge amount of the toner passing through the exposure unit is small, the toner is likely to scatter and adhere to the optical system, so that occurrence of defective images with density non-uniformity may increase. To reduce this phenomenon, it is necessary to increase a charge amount of residual transfer toner before the exposure unit or before charging.

U.S. Pat. No. 7,194,226 discusses providing a developer charge amount control unit to charge a residual transfer toner after transfer processing and before charging processing, and also discusses necessity to achieve a balance between prevention of contamination of a charging member and electric potential unevenness after charging by the developer charge amount control unit. More specifically, it can be understood that when the charging member is prevented from being contaminated by increasing the charge amount of the residual transfer toner with using the developer charge amount control unit, there is a limit to the charge amount of the residual transfer toner that can be increased considering charging unevenness.

Meanwhile, a technique which uses a high coloring toner can save energy since it can reduce toner consumption required to obtain a same density, and also reduce electric power needed to fix a toner image. When a toner amount required to obtain a maximum density is reduced, another advantage can be obtained that a decrease in the charge amount of the residual transfer toner in the transfer unit can be reduced.

When a proximity exposure system is used combined with a CLN-less system, since a toner exists on the photosensitive member and passes through the exposure unit, in order to prevent the toner from adhering to the exposure unit and generating defective images, the charge amount of the residual transfer toner before exposure processing or charging processing needs to be increased. When the toner is prevented from adhering to the exposure unit by providing a developer charge amount control unit between after the transfer processing and before charging processing, the system needs to be enlarged, resulting in an increase in cost. Since there is a limit to increase the charge amount of the residual transfer toner, there are not only contamination of the charging member but also adhesion of toner to the exposure unit and effects of preventing or reducing the generation of defective images are insufficient.

Further, the charge amount of the residual transfer toner can be increased by increasing an absolute value of an average charge amount of a developed image on the photosensitive member. However, if the average charge amount of a developed image is set at as high as not less than 50 μC/g and not higher than 90 μC/g, the developed image cannot be readily transferred from the photosensitive member to paper in the transfer processing.

SUMMARY OF THE INVENTION

According to an aspect of the present invention, an image forming apparatus includes a photosensitive member configured to have a latent image formed thereon by exposure after the photosensitive member has been electrostatically charged, an exposure device which includes a plurality of light emitting elements aligned in a longitudinal direction of the photosensitive member and is arranged with a closest distance of 10 to 5000 μm to the photosensitive member to expose the photosensitive member, a development device configured to develop a latent image on the photosensitive member with a developer and simultaneously recover the developer remaining on the photosensitive member, and a transfer device configured to transfer a developer image developed by the development device to a member to be transferred the image, wherein an absolute value of an average charge of the developer is between 50 μC/g and 90 μC/g after the developer image has been formed on the photosensitive member under an environment of 27° C./70% RH, and a contact angle of the photosensitive member with respect to pure water is not less than 90° and not more than 150°.

As described above, according to the present invention, there is provided an image forming apparatus which can reduce or prevent a decrease in image quality due to contamination of the exposure system while meeting a demand for downsizing of the apparatus, and environmental requirements with regard to energy saving and less waste toner.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
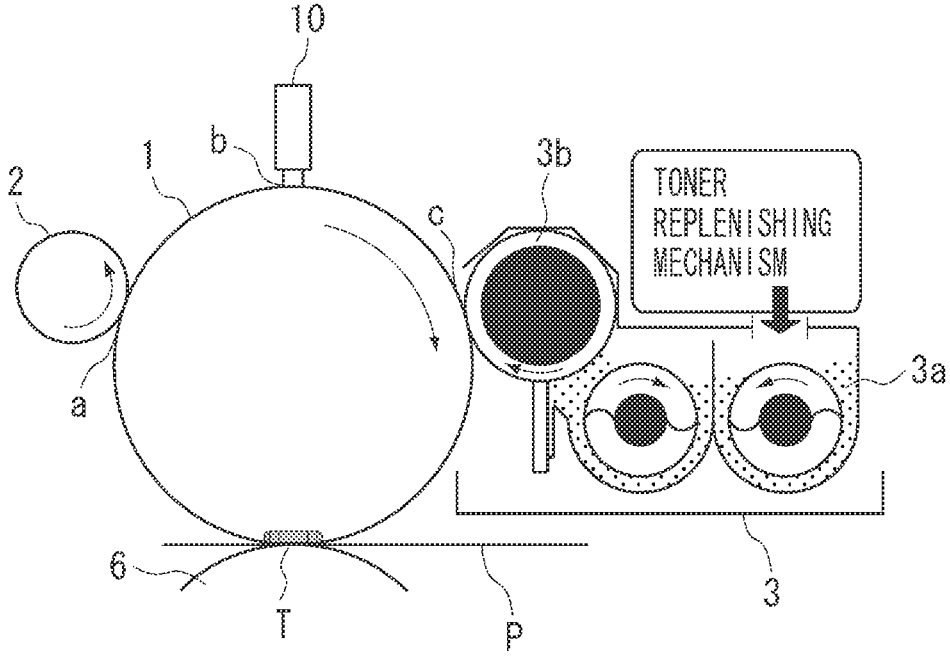
FIG. 1 illustrates a first exemplary embodiment of the present invention.

FIG. 1 is a sectional view of principal parts of an image forming apparatus according to a first exemplary embodiment of the present invention. The illustrated image forming apparatus is an LED printer that uses a transfer method electrophotographic process, adopts a contact charging method, a reversal development method, and a cleaner-less structure, and handles a maximum sheet size of A3. The image forming apparatus performs a series of processing, including charging, exposure, and development on a photosensitive drum 1 as a photosensitive member to form a toner image (developer image) thereon based on image data. The developer image is transferred to an intermediate transfer belt as an intermediate transfer member, and a transferred image is further transferred to recording paper as a transfer material. The toner image on the recording paper is thermally fixed by a fixing device as a permanent image.

Since the reversal development method is used in the present exemplary embodiment, a normal polarity of a developer (a charge polarity of a developer supplied for development) is opposite to a polarity of a voltage applied to the transfer member. Further, the normal polarity of the developer is the same polarity of a voltage applied to the charging member.

The image forming apparatus uses LED in an exposure device, in which a plurality LEDs (light-emitting elements) are arranged in a longitudinal direction of the photosensitive drum 1. When an LED exposure system is used, the photosensitive member and the exposure unit need to be arranged close to each other for reasons of light quantity of LEDs, at a distance of 5000 μm or less.

On the other hand, if the photosensitive member and the exposure unit are too close, beams cannot be brought into focus, which leads to a blurry latent image, resulting in a blurred image. Therefore, the distance between the photosensitive member and the exposure unit is preferably 10 μm or more. An LED printer according to the exemplary embodiment is structured as a cleaner-less type, and is not provided with a cleaning unit dedicated to removing a residual transfer toner somewhat remaining on the surface of the photosensitive drum 1 after a toner image is transferred to an intermediate transfer belt P. The residual transfer toner on the surface of the photosensitive drum 1 is conveyed through a charging region "a" and an exposure region "b" to a development region "c" by a continued rotation of the photosensitive drum 1, and is recovered by development and cleaning (recovering) simultaneous processing by the development device 3 (cleaner-less system).

Since the residual transfer toner on the photosensitive drum 1 passes through the exposure region b, the exposure processing is performed over the residual transfer toner. However, the residual transfer toner is very small in amount, so that no significant effect occurs on the exposure processing. However, the residual transfer toner includes toner particles with a normal charge polarity, toner particles with an opposite polarity (inverse toner), and other toner particles having small charge as mixture. When, among these toner particles, the inverse toner particles and the toner particles with little charge amount pass through the charging region a, the toner particles may adhere to and contaminate the charging roller 2 more than an allowable extent, thus improper charging may occur. If the toner before charging has an opposite polarity, even though the toner receives an electrified charge from the charging roller in a region before and after the charging unit, the toner has an insufficient charge amount and a weak electrostatic adhesion force to the photosensitive drum. As a result, the toner is likely to be suspended in the air before the exposure region b, and adhere to the exposure unit arranged close to the photosensitive drum 1.

In order to effectively recover the residual transfer toner on the surface of the photosensitive drum 1 by the development device 3 (development and cleaning simultaneous processing), the following conditions are required. The residual transfer toner on the photosensitive drum 1 to be carried to the development region c has a normal charge polarity, and the charge amount of the residual transfer toner corresponds to an amount of a toner which can develop an electrostatic latent image on the photosensitive drum 1 by the development device 3. An inverse toner and a toner having an inappropriate charge amount cannot be removed and recovered from the photosensitive drum 1 by the development device 3 and may be causes of defective images.

With diversification of user needs in recent years, in some cases, a large amount of residual transfer toner is generated at once due to continuous printing of images at a high printing ratio, such as photographic images. If the residual transfer toner is generated in large amounts, the problems described above will occur frequently.

Though the present exemplary embodiment is described with reference to a system which includes the intermediate transfer member, the present exemplary embodiment similarly applies to a direct transfer system which uses a transfer material such as paper instead of the intermediate transfer member, or which transfers a toner image to the transfer material on a transfer conveyance belt.

Figure 2:
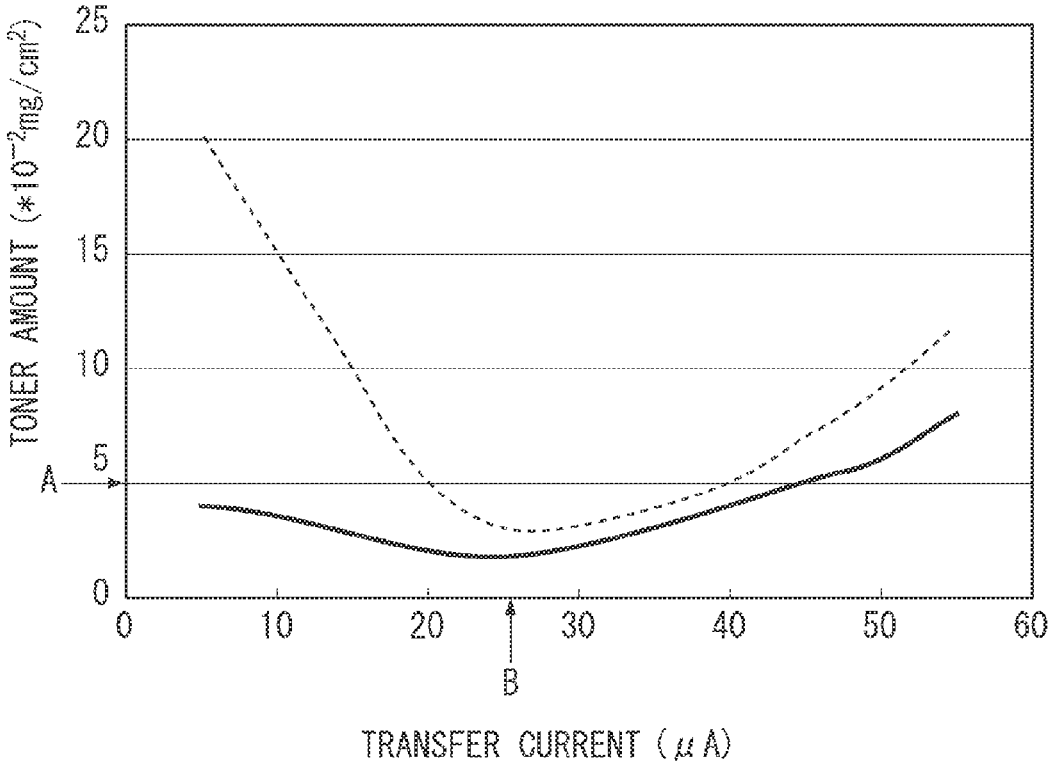
FIG. 2 illustrates an example of relations between a transfer current and a residual transfer toner amount and between the transfer current and a toner amount adhering to a charging roller.

In FIG. 2, a residual transfer amount per unit area is indicated by a broke line and a toner amount adhering to a charging roller is indicated by a solid line when a primary transfer current is varied. The residual transfer toner amount is obtained by collecting the toner remaining on the photosensitive member after transfer using an adhesive tape and converting a change in weight before and after the collection of the toner into a value per unit area. The toner amount adhering to the charging roller is obtained by collecting the toner adhering to the charging roller using the adhesive tape before and after printing of a 100% solid image with a maximum density was continuously performed on one hundred A4-size sheets and converting the collected toner amount into a value per unit area. In the experiment in FIG. 2, an average charge amount of the toner was 30 μC/g (hereafter the charge amount and a current value are expressed in absolute values without polarities). A contact angle with water of the surface of the photosensitive member is 85°. The toner contains six parts of a coloring agent.

From FIG. 2, it can be said that the residual transfer toner amount decreases by increasing the transfer current. However, due to electric discharge that occurs at a transfer nip region and before and after the nip region, some portion of the toner on the photosensitive member receives a charge with a polarity opposite to the polarity of the toner, becomes an opposite polarity toner, and remains as the residual transfer toner. Under an influence of an electric field of the charging unit, the residual transfer toner seems to readily move from the photosensitive member to the charging roller.

If the transfer current is further increased, the residual transfer toner amount begins to increase, and causes an increase in an amount of the toner to adhere to the charging roller.

A proper transfer current value is preferably set at as small transfer current value as possible at least at a target residual transfer tone amount or less. If a target value of the residual transfer toner amount is A (5 mg/cm$^2$), a proper transfer current is B (25 μA). The target value of the residual transfer toner amount is a value to obtain a toner amount at which transfer unevenness caused by a paper texture is not observable on plain paper. When the residual transfer toner amount exceeds the target value thereof, probability of occurrence of the transfer unevenness becomes higher.

If the transfer current is decreased below the proper transfer current value B, it can be understood that though discharge at the transfer nip region and before and after the nip region is weak and the residual transfer toner increases, a proportion of the toner amount transferred to the charging roller is smaller than in a case when the transfer current is increased.

Figure 3:
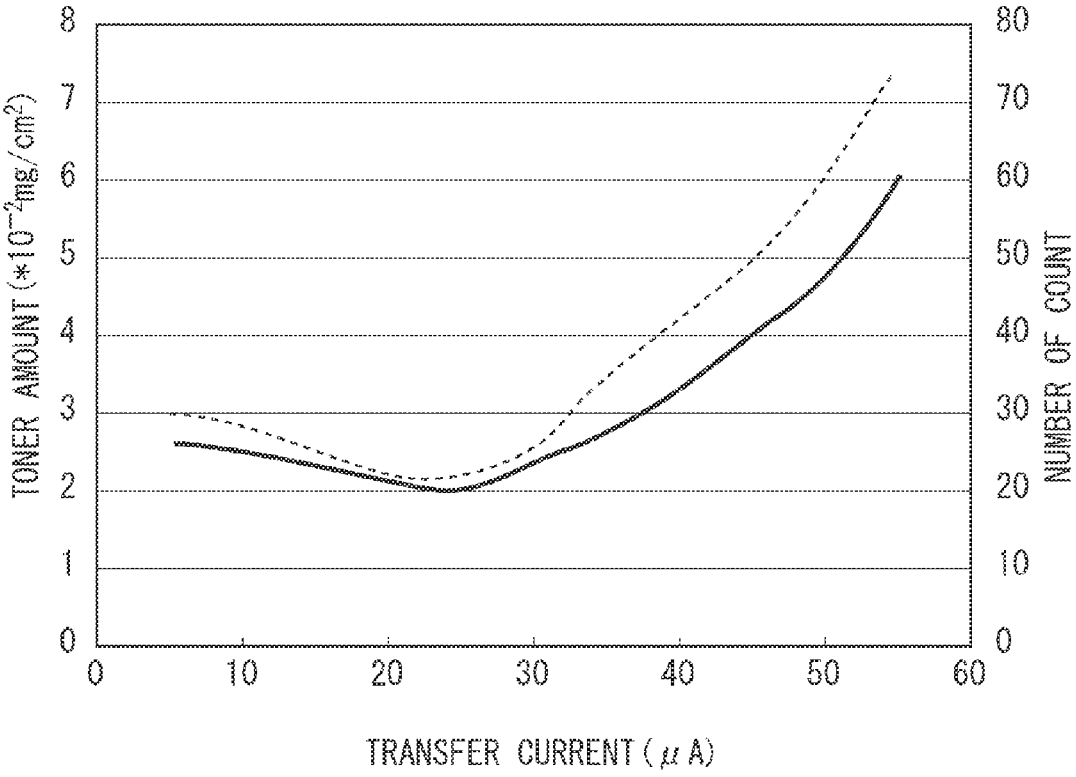
FIG. 3 illustrates an example of relations between a transfer current and a number of suspended particles and between the transfer current and a toner amount adhering to a Selfoc lens array (SLA).

In FIG. 3, a broken line indicates a number of particles as a result of measurement of charged suspended particles, and a solid line indicates the amount of the toner adhering to the surface of a photosensitive member of a Selfoc lens array (SLA) as an LED optical system when the transfer current is varied. The closest distance between the photosensitive member and the exposure system was set to be 2.4 mm.

As a condition for checking toner adhesion to the SLA, values of the suspended toner particles which were measured by a particle counter during a time when printing of a 100% solid image with a maximum density was continuously performed on one hundred A4-size sheets were used. The toner amount adhering to the SLA is obtained by collecting the toner adhering to the SLA before and after the printing using an adhesive tape and converting the collected toner amount into a value per unit area.

The number of the suspended toner particles was counted by a particle counter (CAPA-700, manufactured by Horiba). Measurement was performed at a suction condition of 0.5 l/min during printing of one hundred sheets by setting a particle collection port of the particle counter near the surface of the photosensitive member between the charging roller and the LEDs. From FIG. 3, it is understood that as the proper transfer current is increased, the toner amount adhering to the surface of the photosensitive member of the SLA increases. The reason for this is considered as follows. Though charge of normal polarity is given to the inverse toner and other toners among the residual transfer toner at the charging unit, toner particles which are not charged sufficiently or which are not strongly statically attached to the charging roller or the photosensitive drum fly out in a laminar airflow near the photosensitive member after they are charged.

Figure 4:
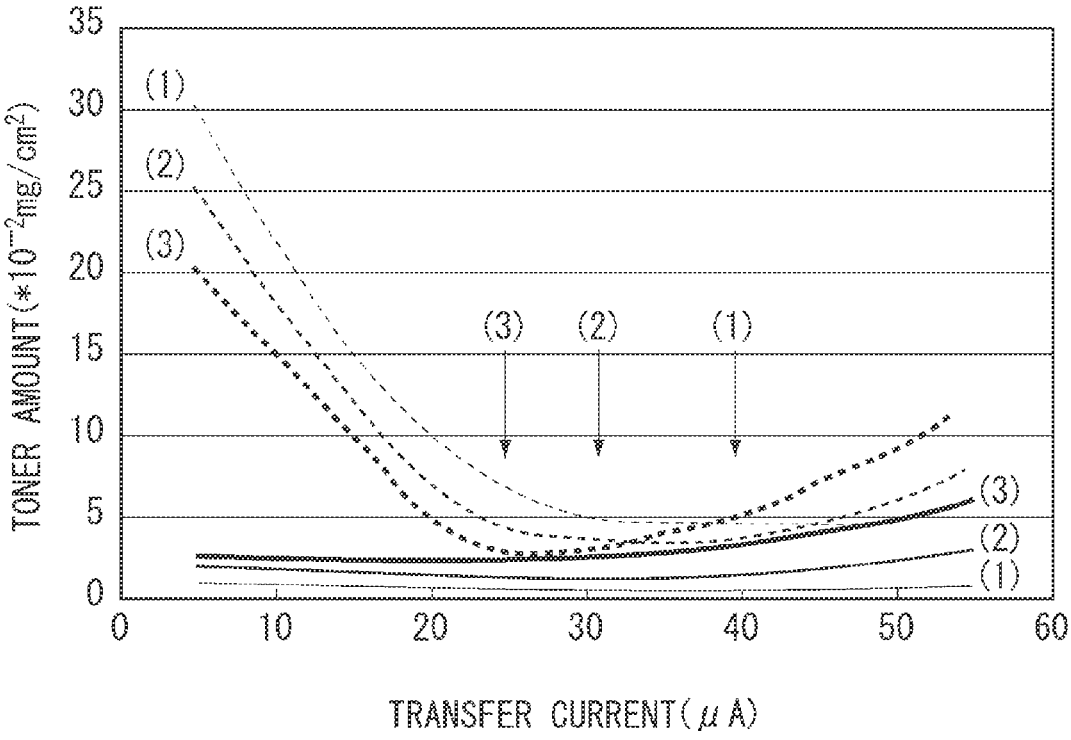
FIG. 4 illustrates an example of relations between a transfer current and a residual transfer toner amount and between the transfer current and a toner amount adhering to the SLA when an average charge amount of the toner is varied.

FIG. 4 illustrates the residual transfer toner amounts (broken lines) and the toner amounts adhering to the SLA (solid lines) when the transfer current was changed. The experiment was conducted by changing the average charge amount of the toner on the photosensitive member after development (in an environment of 27° C. and 70% RH) and lines (1), (2), and (3) indicate the average charge amounts of 90 μC/g, 50 μC/g, and 30 μC/g, respectively. A proper transfer current value is desirably set at as small transfer current value as possible at least at a target residual transfer toner amount or less. When a target value of the residual transfer amount is denoted by A (0.5 mg/cm$^2$) and the average charge amount of the toner is 30 μC/g, the proper transfer current value is a transfer current value indicated by an arrow (3). The proper transfer current value at 50 Cμ/g is indicated by an arrow (2), and the proper transfer current value at 90 μC/g is indicated by an arrow (1).

At the proper current value (3) for the toner with 30 μC/g, the higher the average charge amount of toner ((1) and (2)) becomes, the more the necessary transfer current amount runs short, so that the residual transfer toner amount increases. On the other hand, the higher the average charge amount of toner ((1) and (2)) becomes, the less the toner amount adhering to the SLA is. The reason for this is considered as follows. Even if the toner receives the inverse charge at the transfer unit, the toners with higher average charge amount are more likely to have remaining charge of the normal polarity and the amount of inverse toner decreases in the residual transfer toner.

If the toner with the average charge amount of 30 μC/g is used, when the transfer current is increased larger than the proper transfer current value at 30 μC/g, the contamination of the SLA is increased. In contrast, the toners with the average charge amount of 50 μC/g or more, even if a transfer current larger than the proper transfer current value with respect to the average charge amount of the toner is used, an amount of the contamination of the SLA does not increase so much. Therefore, it can be said that the larger the average charge amount of the toner becomes, the smaller the amount of change in the contamination of the SLA becomes and the more stable relative to a fluctuation in the transfer current.

An example in which the average charge amount of the toner is changed is described below.

As is well known, a two-component developer is used by mixing a toner with a carrier that charges the toner by friction. Well-known carriers include a carrier made by sintering ferrite as a magnetic substance, and a magnetic substance diffused resin carrier, which is made by diffusing a magnetic substance in a resin. In the present exemplary embodiment, a magnetic substance diffused resin carrier is used, which is easy to change a resistance value. A magnetic substance diffused resin carrier is a magnetic resin coated carrier comprised of a core particle as a magnetic substance diffused particle that includes a binder resin and at least a magnetic metal oxide particle, and a resin coating layer covering a surface of a magnetic carrier core particle. For the magnetic substance, magnetite and hematite are used, and a phenol resin is used for a main resin of the carrier. A silicon resin which is high in toner releasing properties is used for a coating on the surface of the carrier.

A volume resistivity measured under a condition close to an actual status of use of a carrier comprising the two-component developer is defined as dynamic resistivity.

In the present exemplary embodiment, a Canon product, CLC 5000 was used. A carrier which is the same weight as the two-component developer filled in the development unit was prepared (400 g in this case). The carrier was filled in the clean CLC 5000 development unit, and the developing roller as a developer bearing member was coated with the carrier. An aluminum cylinder with an outside diameter equal to an outside diameter of the photosensitive member was set to face the developing roller (closest distance between the aluminum cylinder and the developing roller was 400 μm).

The aluminum cylinder was rotated in the circumferential direction at a speed same as in actual use (200 mm/s in this case), and similarly the developing cylinder was rotated (360 mm/s in this case). The aluminum cylinder was connected to ground (electric potential 0V), and a DC voltage was applied to the developing roller so as to provide a +5000V/cm electric field at the closest distance between the aluminum cylinder and the developing roller, and from a flowing current value, the dynamic resistivity of the carrier was obtained.

Magnetite as a low resistance magnetic substance and hematite as a high resistance magnetic substance are used for the carriers in the present exemplary embodiment, and samples which have different levels of dynamic resistivity were prepared by changing a ratio of magnetite to resin and hematite.

Figure 5:
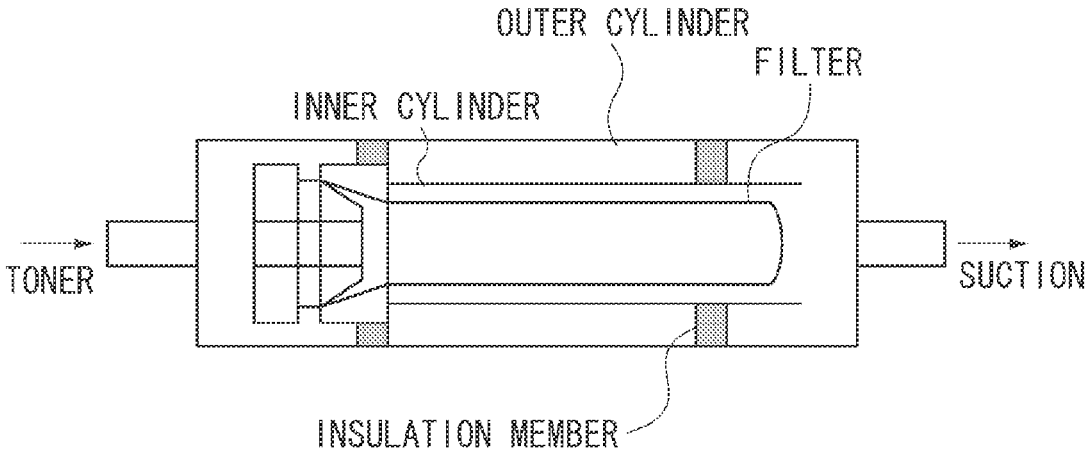
FIG. 5 illustrates a method for measuring an average charge amount of a toner on a photosensitive member.

A method for measuring an average charge amount of the toner on the photosensitive member is described. A Faraday gauge illustrated in FIG. 5 includes a double cylinder which has metal cylinders of different shaft diameters arranged in a concentric manner, and a filter to take in the toner within an inner cylinder. By drawing in the air, the toner was taken in the filter from the surface of the image bearing member (photosensitive member). Since the inner cylinder and the outer cylinder were insulated from each other, an electric charge was induced by electrostatic induction by charge Q of the toner. The induced charge amount was measured by a Keithlay 616 Digital Electrometer, and a value obtained by dividing the induced charge amount by a toner weight M in the inner cylinder (Q/M) was taken as an average charge amount of the toner on the photosensitive member.

Figure 6:
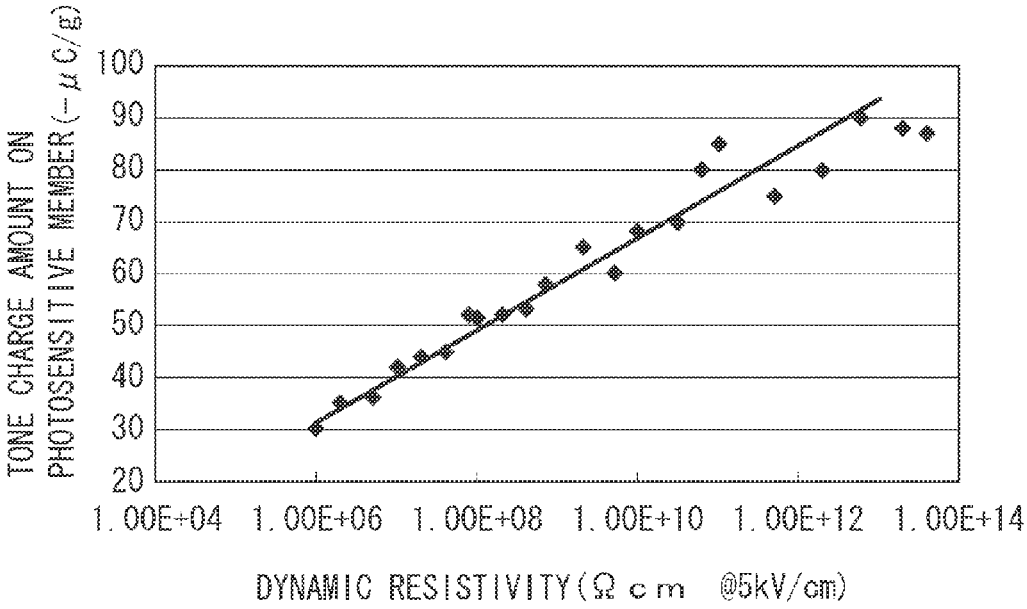
FIG. 6 illustrates an example of a relation between dynamic resistivity of a carrier and an average charge amount of a toner.

FIG. 6 illustrates a relation between the dynamic resistivity of the carrier and the average charge amount of the toner on the photosensitive member. In the present exemplary embodiment, a toner with a volume average particle diameter of 5.5 μm was mixed with the carrier so as to be of 8 weight percent.

From FIG. 6, it can be understood that in order that the average charge amount of the toner on the photosensitive member is not less than 50 μC/g and not more than 90 μC/g, a dynamic resistivity is in a range from 1*108 to 1*1013 Ωcm. When the toner had a higher dynamic resistivity of more than 1*1013 Ωcm, the average charge amount of the toner on the photosensitive member became almost 90 μC/g, and the toner amount used for a developed image on the photosensitive member decreased. This result indicates that the toner charge amount per unit area used in the development decreased, and a state is undesirable in which development efficiency decreases due to increase in the electrostatic adhesion force.

Figure 7:
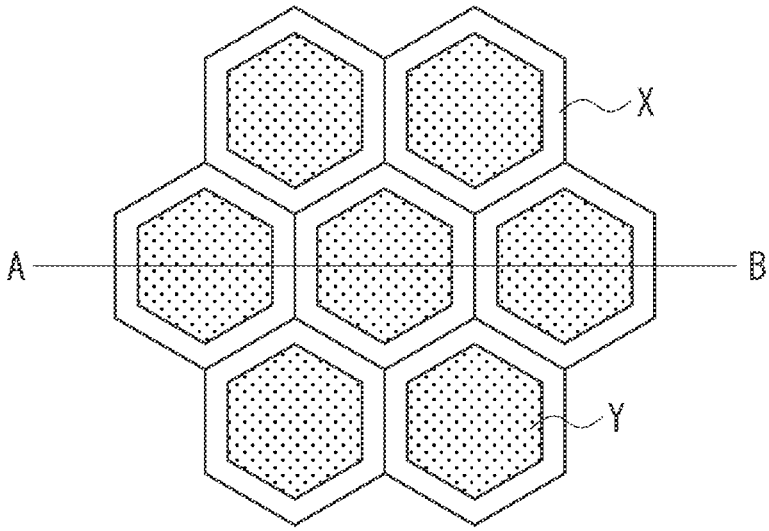
FIG. 7 illustrates an example of a microstructure generated on a surface of the photosensitive member.
Figure 8:
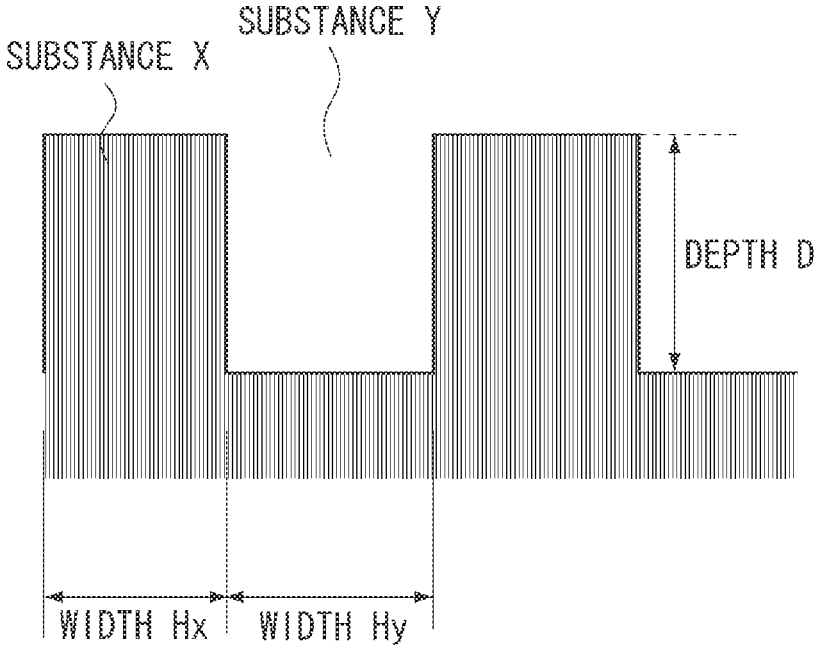
FIG. 8 illustrates a sectional view of the microstructure.

FIG. 7 illustrates an example of a microstructure formed on the surface of the photosensitive member used in the present exemplary embodiment. A part X is a convex portion, and a part Y is a concave portion. In the present exemplary embodiment, a repeated structure was formed based on a hexagonal basic skeleton. So long as the repeated structure is formed, the basic structure is not limited to the hexagonal structure. When an effect of the microstructure is described, it is desirable to use a two dimensional structure analysis, but one dimension is used for the description since the effect can be obtained by a structure that satisfies necessary conditions in one dimension. In the present exemplary embodiment, FIG. 8 illustrates an example of a sectional view taken along a line A-B in FIG. 7 corresponding to a thrust direction of the photosensitive drum.

Polycarbonate was used for a substance X as a photosensitive member surface layer material, and a substance Y was air. Representative values of widths of respective materials were designated as Hx and Hy, and a depth was designated as D. Though the repeated structure was used, in order to take variation into consideration, as a method for measuring Hx and Hy, a fast Fourier transform (FFT) analysis was conducted by measuring a surface profile using an SE-30D made by Kosaka Laboratory Ltd. A Value obtained by converting a frequency peak value corresponding to the concave portion into length was designated as Hy, and a value obtained by converting a frequency peak value corresponding to the convex portion into length was designated as Hx. There is no problem so long as depth D is somewhat larger than an average particle diameter of the toner.

Figure 9:
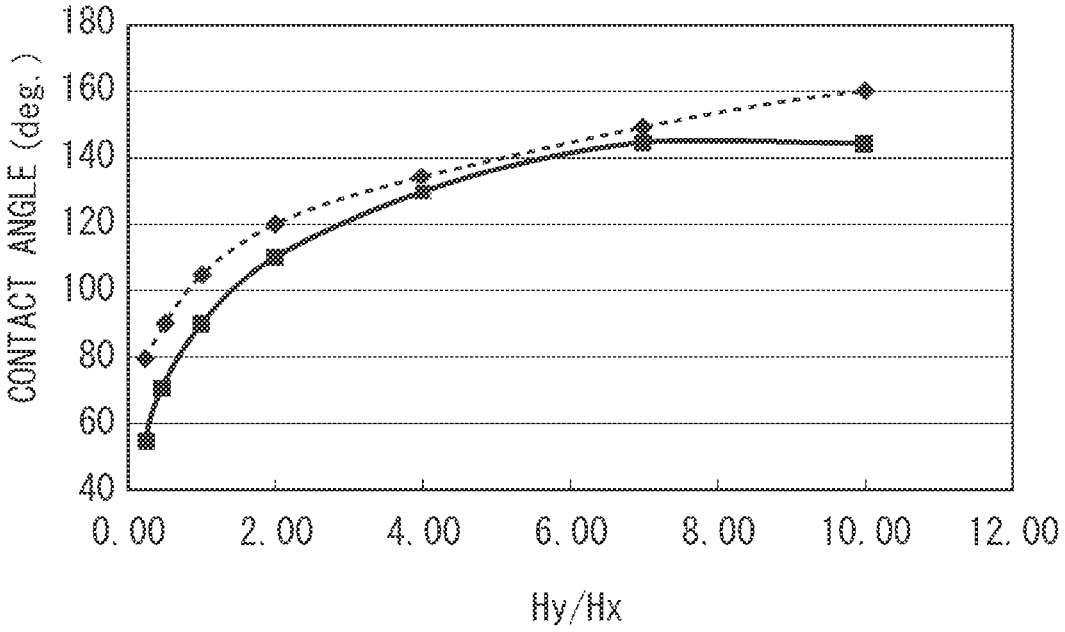
FIG. 9 illustrates a relation between the microstructure and a contact angle.

FIG. 9 illustrates changes in contact angles when the microstructure was adopted for the surface of the photosensitive member. In measuring the contact angles, pure water was used, and as equipment, a contact angle meter CA-DS made by Koyowa Interface Science, Co., Ltd. was used. A measuring environment was 23° C. and 50% RH. It is known that when the surface of the photosensitive member is continuously subjected to charging processing by roller charging or the like, the contact angle decreases. With regard to the representative values Hx and Hy of the microstructure, the surface of the photosensitive member was prepared to have Hy of 4 μm and the values Hy/Hx of 0.5, 1, 2, 4, 7, and 10. A broken line indicates the contact angles before use, and a solid line indicates the contact angles after use (after 5000 A4-size sheets were printed). The contact angle on the surface without the microstructure before use was 80°.

It can be understood that as the value of Hy/Hx increases, the contact angle increases, and a difference before and after use becomes small. Particularly, when Hy/Hx>1 (Hy>Hx), the contact angle is kept larger than 90° even after use. However, Hy is preferably less than the average particle diameter of the toner. This is because as a probability for the toner to contact the bottom of the concave portion becomes higher, the effect of increasing the contact angle by the microstructure decreases. Therefore, to increase the value of Hy/Hx, the value of Hx needs to be reduced, but there is a limit value from the aspect of strength. In the present exemplary embodiment, a partial breakage was observed on the microstructure of the surface of the photosensitive member, in which Hy/Hx was 10, after use, and it seems that the contact angle decreased a little. Therefore, in view of durability, it is preferable to set Hy/Hx to less than 7 in the present exemplary embodiment.

As an initial contact angle, in view of structural durability, an initial setting of Hy/Hx is preferably less than 7, or in terms of a contact angle, the contact angle is preferably not more than 150°.

In the present exemplary embodiment, the surface of the photosensitive member was formed by pressing a metal mold having the microstructure to the photosensitive member in a halfway step in thermal hardening, but the present invention is not limited to this forming method. If the microstructure can be formed by reducing dependence on a surface material of the photosensitive member with respect to a contact angle, a type of material is not limited.

Figure 10:
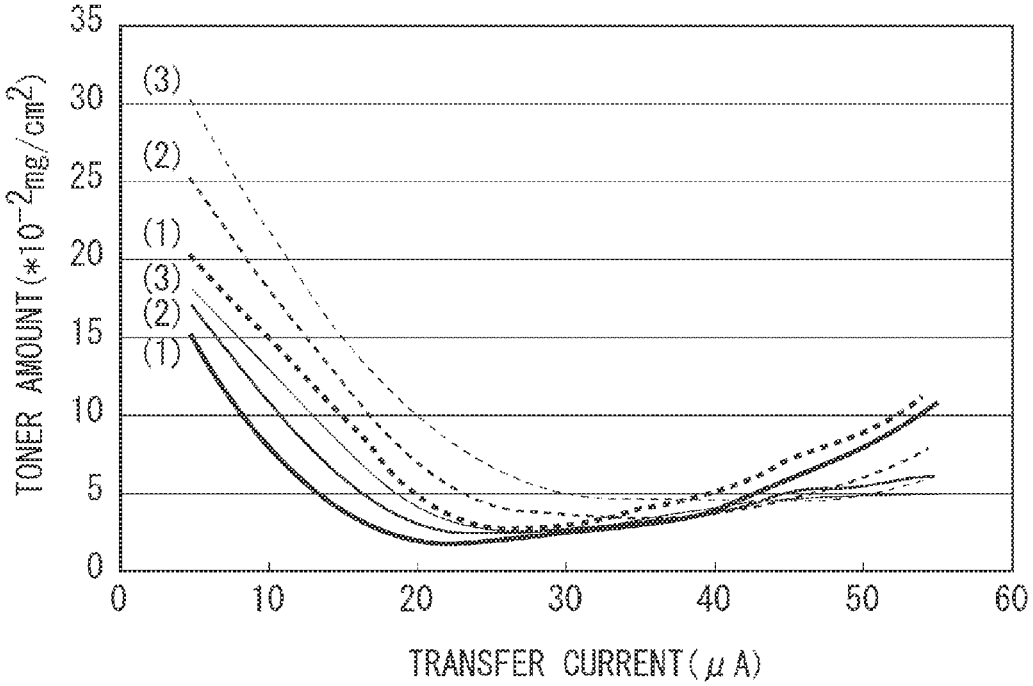
FIG. 10 illustrates an example of relations between a transfer current and a residual transfer toner amount in the presence and absence of the microstructure.

FIG. 10 illustrates a relation between the transfer current and the residual transfer toner amount. Solid lines indicate data when the microstructure with Hy/Hx of 7 according to the present exemplary embodiment was formed on the surface of the photosensitive member, and broken lines indicate data when the microstructure was not formed. When the microstructure with Hy/Hx of 7 was formed on the surface of the photosensitive member, the initial contact angle with respect to pure water was 150°. When the microstructure was not formed, the contact angle with respect to pure water was 85°. As described above, when the microstructure is formed, it becomes possible to increase the contact angle. Lines (1) indicate data when the toner average charge amount on the photosensitive member after development is 30 μC/g. Similarly, lines (2) indicate data at 50 μC/g, and lines (3) indicate data at 90 μC/g. By increasing the contact angle on the surface of the photosensitive member, the residual transfer toner amount can be reduced at small transfer current. In other words, it is understood that a rise in transfer efficiency is accelerated and a desired level of transfer efficiency can be obtained by a small transfer current. Therefore, when the toner charge amount after development is increased, by increasing the contact angle on the surface of the photosensitive member, a desired transfer efficiency can be obtained without increasing the proper transfer current so much.

Figure 11:
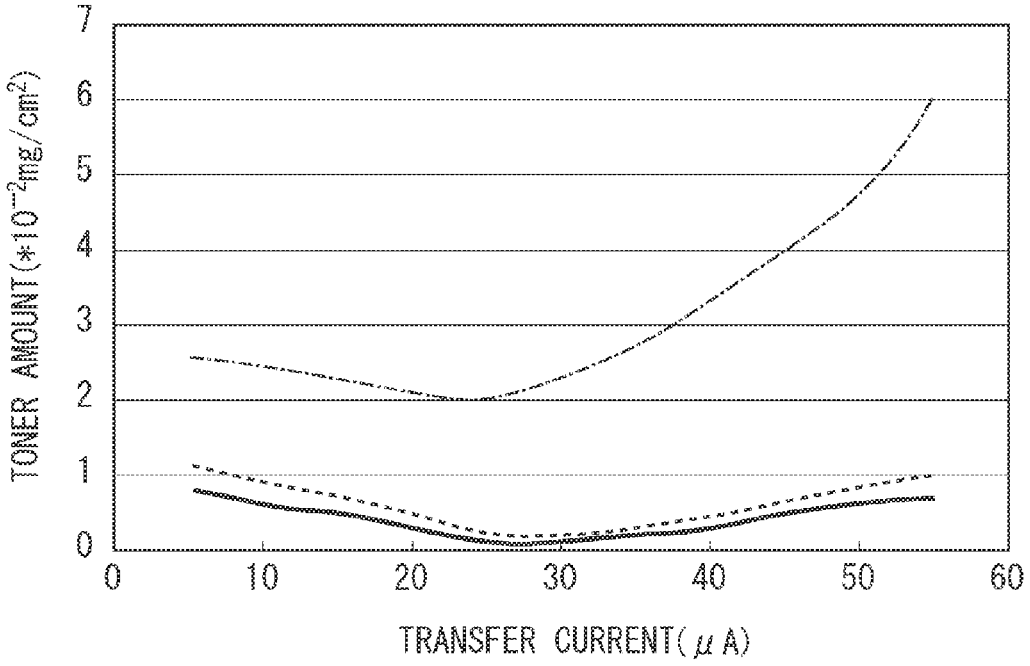
FIG. 11 illustrates an example of relations between a transfer current and a toner amount adhering to the SLA when an average charge amount of the toner is varied.

FIG. 11 illustrates changes in the toner amount adhering to the SLA when the transfer current was varied under the same condition as the above described condition for checking toner adhesion to the SLA. A dash-dotted line indicates contamination of the SLA when the photosensitive member with a conventional surface was used at an average toner charge amount of 30 μC/g after development. A broken line and a solid line indicate contamination of the SLA when the photosensitive member with large contact angle on its surface was used at an average toner charge amounts of 50 μC/g and 90 μC/g, respectively.

From FIG. 11, it can be understood that the toner amount remaining on the photosensitive member after image transfer is smaller on the photosensitive member with the microstructure. Therefore, the photosensitive member with the microstructure can use a toner with a high average toner charge amount after development. Further, it is understood that by using a toner with a high average toner charge amount after development, the charge of residual transfer toner is less likely to have its polarity inverted, and the adhesion of the toner to the SLA can be reduced or prevented.

Table 1 illustrates the residual transfer toner amount, contamination of the LED (SLA), and the durability of photosensitive member surface structure at different contact angles on the photosensitive member, and at a toner average charge amount of 30 μC/g, 50 μC/g, and 90 μC/g on the photosensitive member. Regarding the contamination of the LED (SLA), results are shown which were obtained when a closest distance between the surface of the photosensitive member and the SLA was 2.4 mm and 10 μm.

With a drum A, a microstructure was not formed on its surface layer, and the drum A was used in an image forming apparatus in FIG. 1 after 1000 solid white sheets had been continuously fed through the apparatus. Since it is well known that after image forming processing is repeated, the surface of the photosensitive member is modified by charging processing, and the contact angle is reduced, this phenomenon was utilized in the present exemplary embodiment. Drums B, C, D, and E were prepared so that Hy/Hx on the drum surface layer would be 0.25, 0.5, 7, and 10 in respective different drums (continuous sheet feeding was not performed).

The residual transfer toner amounts were evaluated as follows. With reference to the above described toner amount target value A (0.05 mg/cm$^2$), a toner which had the residual transfer toner amount of not more than A (0.05 mg/cm$^2$) even after considering a fluctuation of the transfer current (±10% of the transfer current corresponding to a minimum residual transfer tone) is indicated by a "○" mark in the table. A toner which had the residual transfer toner amount of lower than the target value after considering twice fluctuation of the transfer current is indicated by a "@" mark. A toner which had its minimum residual transfer toner amount higher than the target value A (0.05 mg/cm$^2$) within a range of fluctuation of the transfer current is indicated by a "X" mark. A toner which had its minimum residual transfer toner amount partially lower than the target value A (0.05 mg/cm$^2$) within the range of fluctuation of the transfer current is indicated by a "Δ" mark. With regard to the contamination of the LEDs, changes in image density unevenness were evaluated according to different types of image processing before and after printing of a 100% solid image with a maximum density was continuously performed on one hundred A4-size sheets.

@: Density unevenness remained the same—by density 0.6, and error diffusion processing ○: Density unevenness remained the same—by density 0.6, and 160-line screen processing Δ: Density unevenness changed—by density 0.6, 100-line and 160-line screen processing X: Density unevenness changed—in maximum solid density XX: Maximum solid density was not obtained The surface structure durability was evaluated by observing the surface of the photosensitive member after printing 5000 A4-size sheets. The drum with the microstructure remained intact is indicated by a ○ mark and those with the microstructure damaged is indicated by a X mark.

From the tables below, it is understood that when the toner average charge amount was not less than 50 μC/g and the contact angle on the surface of the photosensitive member was in a range from 90° to 160°, the residual transfer toner amount and contamination of the LED (SLA) were reduced, but were at not acceptable levels when the contact angle was less than 90°. Considering the durability of the microstructure provided on the surface of the photosensitive member, the toner average charge amount is preferably not less than 90° and not more than 150°.

TABLE 1

| | Drum A | Drum B | Drum C | Drum D | Drum E |
|---|---|---|---|---|---|
| Toner tribocharge 30 μC/g | | | | | |
| Contact angle | 45 | 85 | 90 | 150 | 160 |
| Residual transfer toner amount | X | ○ | @ | @ | @ |
| LED contamination A/B: photosensitive member-SLA closest distance 2.4 mm/10 μm | X/XX | X/XX | X/XX | X/XX | X/XX |
| Surface structure durability | — | ○ | ○ | ○ | X |
| Toner tribocharge 50 μC/g | | | | | |
| Contact angle | 45 | 85 | 90 | 150 | 160 |
| Residual transfer toner amount | X | Δ | ○ | @ | @ |
| LED contamination A/B: photosensitive member-SLA closest distance 2.4 mm/10 μm | Δ/X | ○/Δ | @/○ | @/○ | @/○ |
| Surface structure durability | — | ○ | ○ | ○ | X |
| Toner tribocharge 90 μC/g | | | | | |
| Contact angle | 45 | 85 | 90 | 150 | 160 |
| Residual transfer toner amount | X | X | ○ | ○ | ○ |
| LED contamination A/B: photosensitive member-SLA closest distance 2.4 mm/10 μm | @/X | @/○ | @/○ | @/○ | @/○ |
| Surface structure durability | — | ○ | ○ | ○ | X |

In the above described exemplary embodiment, amorphous pulverized toner was used. Sphericity of the toner can be expressed by toner shape factors SF-1 and SF-2, which is discussed in Japanese Patent Application Laid-Open No. 09-274364. SF-1 and SF-2 of the pulverized toner used in the present exemplary embodiment were 160 and 130, respectively.

To examine the toner and the effects of the present invention, a similar experiment was conducted using a polymerized toner with high sphericity. The SF-1 and the SF-2 of the polymerized toner were 120 and 115, respectively. Results of the experiment are shown in Table 2.

TABLE 2

| | Drum A | Drum B | Drum C | Drum D | Drum E |
|---|---|---|---|---|---|
| Toner tribocharge 30 μC/g | | | | | |
| Contact angle | 45 | 85 | 90 | 150 | 160 |
| Residual transfer toner amount | X | ○ | @ | @ | @ |
| LED contamination A/B: photosensitive member-SLA closest distance 2.4 mm/10 μm | X/XX | X/XX | X/XX | X/XX | X/XX |
| Surface structure durability | — | ○ | ○ | ○ | X |
| Toner tribocharge 50 μC/g | | | | | |
| Contact angle | 45 | 85 | 90 | 150 | 160 |
| Residual transfer toner amount | X | ○ | ○ | @ | @ |
| LED contamination A/B: photosensitive member-SLA closest distance 2.4 mm/10 μm | Δ/X | ○/Δ | @/○ | @/○ | @/○ |
| Surface structure durability | — | ○ | ○ | ○ | X |

TABLE 2-continued

| | Drum A | Drum B | Drum C | Drum D | Drum E |
|---|---|---|---|---|---|
| Toner tribocharge 90 μC/g | | | | | |
| Contact angle | 45 | 85 | 90 | 150 | 160 |
| Residual transfer toner amount | X | Δ | ○ | ○ | ○ |
| LED contamination A/B: photosensitive member-SLA closest distance 2.4 mm/10 μm | @/X | @/○ | @/○ | @/○ | @/○ |
| Surface structure durability | — | ○ | ○ | ○ | X |

From the tables, it is understood that when the toner average charge amount is not less than 50 μC/g, the residual transfer toner and the LED (SLA) contamination were at acceptable levels when the contact angle of the surface of the photosensitive member was in a range of not less than 90° and not more than 160°. In the view of effects of the present invention, the residual transfer toner amount and the LED (SLA) contamination were considered to be at acceptable levels when the contact angle was larger than 160°. However, there is a concern about decrease in the durability of the surface structure when the photosensitive member has a contact angle of larger than 160°. Therefore, the present invention specifies that the contact angle of the photosensitive member is not more than 150° as a practical range. When a photosensitive member with a small contact angle was used, the residual transfer toner amount was improved a little. It can be seen that when the contact angle was less than 90°, results were unacceptable. Since similar effects were obtained by a polymerized toner or a pulverized toner, it is understood that the present invention is not affected by types of toner. Generally, a polymerized toner can be manufactured with a narrow particle size distribution and with a narrow charge distribution, so that an average charge amount of the toner can be easily controlled. Therefore, a polymerized toner is suitable for the present invention In the first exemplary embodiment, contact angles can be made larger by providing the microstructure on the surface of the photosensitive member, but the present invention is not limited to this structure of the drum. For example, as discussed in Japanese Patent Application Laid-Open No. 06-250413 and No. 07-230177, by using a water-repellent material for the surface of the photosensitive member, similar effects as in the first exemplary embodiment can be provided though the water-repellent material is inferior in respect of maintaining the contact angle after use.

In the present exemplary embodiment, in a two-component development system, the average charge amount of the toner on the photosensitive member is increased by increasing the dynamic resistivity of the carrier, but the present invention is not limited to this structure. For example, in a structure discussed in Japanese Patent Application Laid-Open No. 2001-13788, the average charge amount of the toner can be increased. More specifically, a toner charging roller which can apply a bias voltage and is in contact with the developing roller is provided downstream of a facing portion of a toner regulating blade of the development device and upstream of a facing portion of the photosensitive member. By applying the bias voltage to the toner charging roller, the average charge amount of the toner on the photosensitive member can be set to not less than 50 μC/g and up to 90 μC/g even in a one-component development system, and similar effects as in the present exemplary embodiment can be obtained.

As described above, according to the present invention, in a proximity exposure system with a closest distance between the exposure unit and the photosensitive member of not less than 10 μm and not more than 5000 μm, and with a CLN-less system, the average charge amount of a developed image on the photosensitive member is set at a high value of not less than 50 μC/g and not more than 90 μC/g. Accordingly, the contamination of the exposure unit by residual transfer toner can be reduced or prevented without causing cost increase. In the experiment, the distance between the photosensitive member and the exposure unit was set at two conditions, 10 μm and 2.4 mm (24000 μm). Effects have been verified at the distance between the photosensitive member and the exposure unit of 24000 μm in which the exposure unit is more likely to be affected by contamination of the residual transfer toner than at a distance of 5000 μm. Therefore, the effects of the present invention can be obtained when the distance between the photosensitive member and the exposure unit is 5000 μm.

When the average charge amount of a developed image on the photosensitive member is set to a high value not less than 50 μC/g and not higher than 90 μC/g, it becomes difficult to transfer the developed image from the photosensitive member in transfer processing. Thus, it is effective to reduce a non electrostatic adhesion force causing adhesion to the photosensitive member. When the average charge amount of a developed image on the photosensitive member is higher than 90 μC/g, the electrostatic adhesion force becomes too large. Too large electrostatic adhesion force is harmful because a developing bias voltage cannot be increased higher than a limit level of leakage of development electric field and the development property is likely to decrease. In the present invention, the average charge amount of a developer on the photosensitive member is measured at a position after exposure and before transfer, and is determined by absolute values since the average charge amount of the developer has nothing to do with polarities. Therefore, transferability is secured by increasing the contact angle on the surface of the photosensitive member to pure water (in other words, by increasing toner releasing properties.) Especially, in view of a fact that the contact angle decreases from use of the apparatus, it is effective to reduce the contact angle by forming a microstructure on the surface of the photosensitive member.

It is known that a toner amount required to obtain a same density can be reduced by increasing a coloring agent as a base material of a toner.

Figure 12:
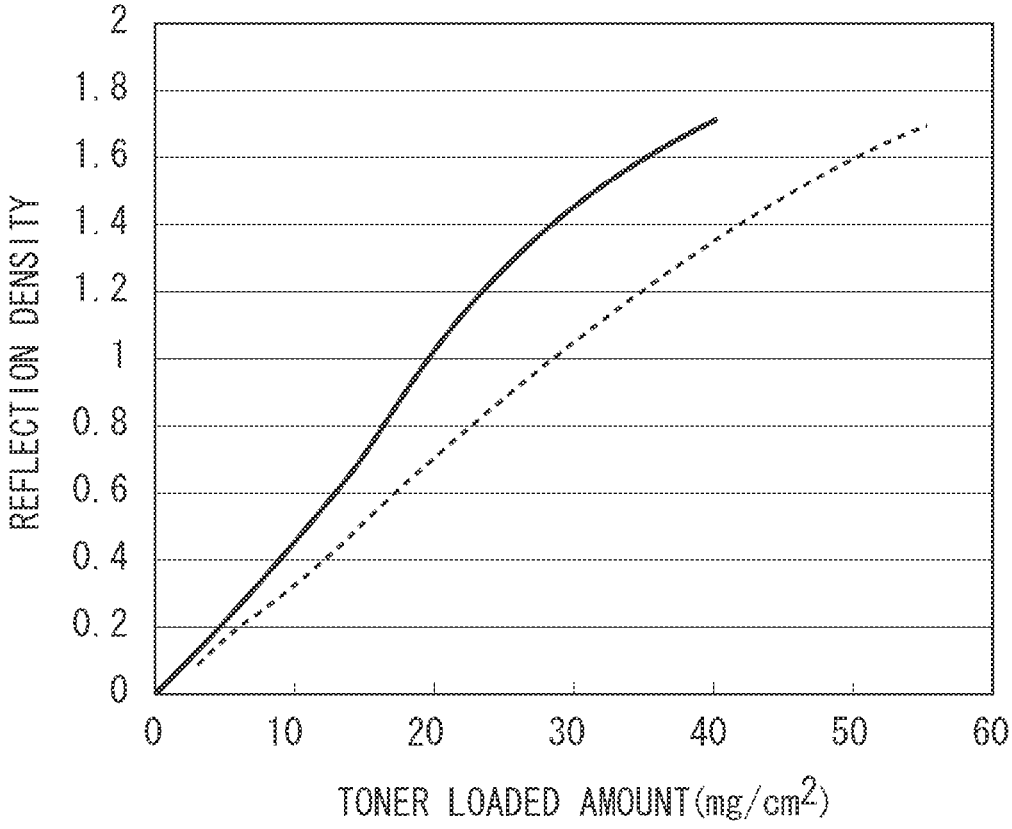
FIG. 12 illustrates an example of a relation between a toner amount and density when a number of parts by weight of coloring agent is varied.

FIG. 12 illustrates a reflection density of a toner on paper when a developed toner amount per unit area on the photosensitive member was changed. A broken line indicates a case where a coloring agent was 6 parts by weight, and a solid line indicates a case where the coloring agent was 10 parts by weight. It can be understood that a toner amount required to obtain a maximum density of 1.6 is 50 mg/cm$^2$ when the coloring agent was 6 parts by weight, and 35 mg/cm$^2$ when the coloring agent was 10 parts by weight.

On the other hand, when a weight ratio of a coloring agent is increased, if a toner amount is too small, the maximum density cannot be obtained. Therefore, at least a closest-packing amount A (mg/cm$^2$) of a toner in one layer with an average particle size is required. The amount A can be calculated using the formula, $A=2\pi r\rho/3\sqrt{3}$, (in which r (cm) is a radius of a toner average particle diameter, and ρ is a toner's true specific gravity (mg/cm$^3$). Considering a melting and spreading amount of a toner at a fixing unit and non-uniformity of developing properties in each processing step, such as development step, the amount A to 1.3A (mg/cm$^2$) of toner is preferably to be developed. In other words, supposing that a maximum amount of a developer per unit area is designated as B, a relation of $A<B<1.3A$ is to be satisfied. As for a method for measuring a developer amount per unit area, the method described in the method for measuring an average charge amount of a toner on the photosensitive member is used. More specifically, an area where the toner on the photosensitive member has been drawn in is measured, or a solid image in a predetermined area is developed and the toner thereon is drawn in, and a value obtained by dividing a drawn-in toner amount by the measured area is taken as the developer amount per unit area.

Figure 13:
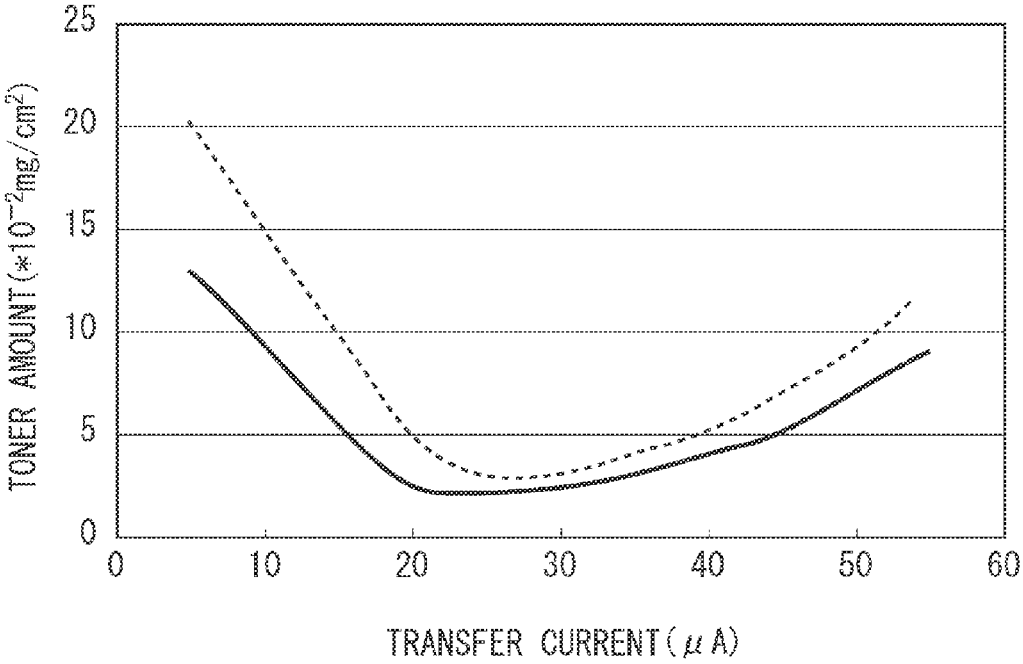
FIG. 13 illustrates an example of a relation between a transfer current and a residual transfer amount when a number of parts by weight of coloring agent is varied.

FIG. 13 illustrates a residual transfer toner amount with respect to a transfer current when the average toner charge amount on the photosensitive member after development is 30 μC/g. A broken line indicates a case where the toner includes a coloring agent of 6 parts by weight, and a solid line indicates a case where the toner includes the coloring agent of 10 parts by weight. It can be seen that an optimum transfer current is smaller in the toner including 10 parts by weight of the coloring agent than in the toner including 6 parts by weight of the coloring agent. The average toner charge amount per unit weight (μC/g) of the toner on the photosensitive member was the same between the toner with 6 parts by weight of the coloring agent and the toner with 10 parts by weight of the coloring agent. However, the toner amount per unit area (g/cm$^2$) on the photosensitive member is smaller for the toner with 10 parts by weight of the coloring agent. Therefore, a total toner charge amount (μC/cm$^2$) per unit area of the toner is reduced, and smaller transfer current is required. The reason for this is considered as follows. Since electric discharge at the transfer unit is small, probability of applying inverse charge to the toner at the transfer unit becomes smaller, and an inversely charged toner decreases in quantity. Further, it can be considered that when a loaded toner amount is small at a larger transfer current than at a proper transfer current, the inversely charged toner is small in quantity and this fact also contribute to lessen the required transfer current.

Figure 14:
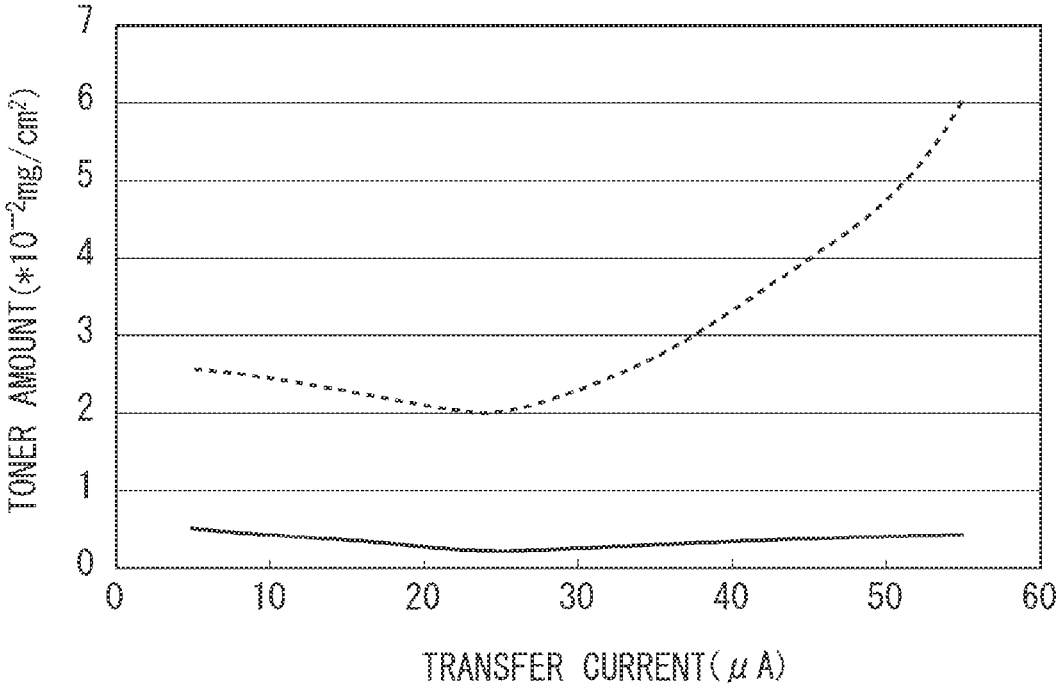
FIG. 14 illustrates an example of a relation between a transfer current and a toner amount adhering to the SLA when a number of parts by weight of coloring agent and average charge amount of the toner are varied.

FIG. 14 illustrates changes in the contamination of the SLA when an amount of a toner on the photosensitive member which was enough to obtain a maximum density was developed and the transfer current was varied. A broken line indicates a case where a toner including 6 parts by weight of the coloring agent and having the average toner charge amount of 30 μC/g on the photosensitive member was used, and a solid line indicates a case where a toner including 10 parts by weight of the coloring agent and having the average toner charge amount of 50 μC/g on the photosensitive member was used. From FIG. 14, including a case where the proper transfer current is applied, it can be understood that the toner amount adhering to the SLA can be reduced by increasing an amount of the coloring agent to reduce the toner amount on the photosensitive member, and increasing the average charge amount of the toner.

As described above, when 10 parts by weight of the coloring agent was used instead of conventional 6 parts by weight, since a toner amount required to obtain the same density is reduced, the charge amount of the toner layer is also reduced, and an optimum transfer current can be reduced. Therefore, supply of inverse charge to the toner at the transfer unit can be suppressed, so that the SLA can be prevented from being contaminated. In other words, when a weight ratio of a coloring agent is high as in the second exemplary embodiment, it may be said that the SLA contamination can be prevented more readily than in the first exemplary embodiment. Therefore, under the conditions that can provide the effects of the present invention in the first exemplary embodiment (an average charge amount of 50 μC/g to 90 μC/g and a contact angle of the surface of the photosensitive member to water of not less than 90° up to 180°), the effects of the present invention can be obtained also in the second exemplary embodiment.

On the other hand, a problem in the use of a high coloring toner is that when a toner charge amount in the development unit is the same as conventional levels, the contrast in a latent image required to obtain the same density becomes low, and γ characteristic representing a density gradation relative to a contrast potential of the latent image increases sharply. In this respect, there is a problem that when the potential changes due to disturbance or the like, the density changes greatly, so that changes in color to cause inferior images occurs especially in a color image forming apparatus. However, by using a toner which has a charge amount larger than the conventional ones, for example to have an average toner charge amount of 50 to 90 μC/g, and includes a large amount of pigment as in the present invention, it become possible to maintain a relatively high charge amount of residual transfer toner in the transfer unit. Moreover, by using a high level of average charge amount of a developed image on the photosensitive member, such as not less than 50 μC/g and not more than 90 μC/g, the contrast in a necessary latent image can be increased, and density change with respect to the potential change due to disturbance is reduced, so that changes in color can be also reduced. Therefore, the present invention is suitable for using toners with a high weight ratio of a coloring agent.

As in the first exemplary embodiment, when an average charge amount of a developed image on the photosensitive member is set at a high value, such as not less than 50 μC/g and not higher than 90 μC/g, it becomes difficult to transfer the developed image from the photosensitive member in the transfer processing, it is effective to reduce a non electrostatic adhesion force causing adhesion to the photosensitive member. Thus, the transferability is secured by increasing the contact angle of the surface of the photosensitive member to water.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-174520 filed Jul. 27, 2009, which is hereby incorporated by reference herein in its entirety.

What is claimed is:

1. An image forming apparatus comprising:

a photosensitive member configured to have a latent image formed thereon by exposure after the photosensitive member has been electrostatically charged;

an exposure device including a plurality of light emitting elements aligned in a longitudinal direction of the photosensitive member;

a development device configured to develop a latent image on the photosensitive member with a developer and simultaneously recover the developer remaining on the photosensitive member; and a transfer device configured to transfer a developer image developed by the development device to a member to be transferred the image, wherein an absolute value of an average charge amount of the developer is between 50 μC/g and 90 μC/g after the developer image has been formed on the photosensitive member under an environment of 27° C./70% RH, wherein a contact angle of the photosensitive member with respect to pure water is not less than 90° and not more than 150°, and wherein when a microstructure is formed on a surface of the photosensitive member and a surface shape of the microstructure is subjected to a Fourier transformation, a value of a length converted from a frequency peak value corresponding to a concave portion of the microstructure is denoted by Hy, a value of a length converted from the frequency peak value corresponding to a convex portion of the microstructure is denoted by Hx, and Hy>Hx is satisfied and Hy is not more than an average particle diameter of the developer.

2. The image forming apparatus according to claim 1, wherein the exposure device is arranged with a distance from 10 to 5000 μm to the photosensitive member to expose the photosensitive member.

3. The image forming apparatus according to claim 2, wherein when a maximum developer amount per unit area of the developer image formed on the photosensitive member is denoted by B and an amount when the developer with an average particle diameter is closest packed in one layer is denoted by A, a relation of A<B<1.3A is satisfied.

4. The image forming apparatus according to claim 1, wherein the plurality of light emitting elements include LEDs.

* * * * *